United States Patent [19]

Miyaoka et al.

[11] 4,444,871

[45] Apr. 24, 1984

[54] METHOD FOR FORMING A DIRECT POSITIVE COLOR IMAGE

[75] Inventors: Kazuyoshi Miyaoka, Akishima; Shigeharu Koboshi, Sagamihara, both of Japan

[73] Assignee: Konishiroku Photo Industry Co., Ltd., Tokyo, Japan

[21] Appl. No.: 429,157

[22] Filed: Sep. 30, 1982

[30] Foreign Application Priority Data

Oct. 8, 1981 [JP] Japan ..... 56-161719

[51] Int. Cl.[3] ..... G03C 7/16

[52] U.S. Cl. ..... 430/378; 430/139; 430/409; 430/486; 430/940

[58] Field of Search ..... 430/378, 139, 409, 410, 430/394, 494, 940, 486

[56] References Cited

U.S. PATENT DOCUMENTS

| | | | |
|---|---|---|---|
| 2,672,416 | 3/1954 | Stanton | 430/139 |
| 3,269,840 | 8/1966 | Pattyn et al. | 430/139 |
| 3,779,766 | 12/1973 | Tsuji et al. | 430/536 |
| 3,779,776 | 12/1973 | Vanassche et al. | 430/378 |
| 3,850,638 | 11/1974 | Willis et al. | 430/410 |
| 4,279,987 | 7/1981 | Ogi et al. | 430/409 |

*Primary Examiner*—J. Travis Brown

*Attorney, Agent, or Firm*—Frishauf, Holtz, Goodman & Woodward

[57] ABSTRACT

Method for forming a direct positive-color image in which an imagewise exposure is applied to a direct positive silver halide color photosensitive material comprising a support and at least one light-sensitive silver halide emulsion layer which contain internal latent image type silver halide grains whose surfaces are not fogged, said method including applying a fogging exposure and color development wherein said fogging exposure is applied in a wet condition with a solution containing at least one fluorescent whitening agent.

6 Claims, No Drawings

METHOD FOR FORMING A DIRECT POSITIVE COLOR IMAGE

The present invention relates to a direct positive color image forming process, and relates more particularly to improvements in image qualities of a direct positive silver halide color photosensitive material from which a direct positive color image can be obtained through a surface development process in which a fogging exposure is an accompaniment thereof after an imagewise exposure is applied.

It has generally been well-known that a direct positive image can be formed by making use of a silver halide photosensitive material without any intermediate processing step or any negative photographic image.

The processes which are used for forming a positive image by making use of a direct positive type silver halide photosensitive material that has so far been known; may be classified, excluding peculiar ones, mainly into two types taking into consideration of the practical usability.

In the one type, there uses a silver halide emulsion which has been fogged in advance and the fog nuclei (i.e., the latent image) in an exposed area are destroyed by utilizing a solarization or a Harshel effect, and thus a positive image is obtained after the development is completed.

In the other type, there uses an internal-latent-image type silver halide emulsion which has not been fogged and an imagewise exposure is made, and then a surface development is made with or after a fogging process.

The above-mentioned internal-latent image type silver halide photographic emulsion means such a silver halide photographic emulsion as that has the sensitivity specks mainly inside the silver halide grains and a latent image is formed inside the grains by exposing to light.

The image forming process for the latter type is generally higher in sensitivity and is suitable for the applications which require the high sensitivity as compared with the image forming process for the former type. The present invention relates to the image forming process for the latter type.

In the aforementioned technical field, there have been a variety of well-known technics so far such as those described in U.S. Pat. Nos. 2,592,250, 2,466,957, 2,497,875, 2,588,982, 3,761,266, 3,761,276 and 3,796,577, and British Pat. No. 1,151,363, which are the typical examples of the technics.

When the abovementioned publicly known technics are employed, it is possible to prepare a photosensitive material that is relatively high in the sensitivity for serving as a direct positive type material.

With respect to the details of the direct positive image forming mechanism, it is hard to say that the explicit descriptions have been given so far, however, it may be possible to understand to a certain extent the processes to form a positive image through the observations on "the desensitization action of an internal latent image" as described in, for example, Mees and James "The Theory of the Photographic Process", 3rd, Ed., P.161.

To be more precise, it may be considered that a fog nuclei is produced selectively only on the surface of an unexposed silver halide grain by the surface desensitization action that is originated in the so-called internal latent image produced inside a silver halide grain by the initial imagewise exposure and an image is then formed in the unexposed area through an ordinary development process.

As stated above, as for the methods for selectively producing a fog nuclei, there have been well known two methods, that is, the one is that a fog is produced by applying the so-called "light-fogging" that is to produce a fog by exposing the whole surface of a photosensitive layer to light, and the other one is that a fog is produced by applying the so-called "chemical-fogging" that is to produce a fog with using of a chemical such as a fogging agent.

Among those methods, a mechical-fogging method has, inter alia, such defects that the deterioration of a fogging agent is apt to be caused by an air oxidation, so that the fogging effect is remarkably lowered, due to the fact that there is strict condition that the effect of a fogging agent cannot be obtained unless the pH value of the fogging agent reaches up to pH 12 or higher.

On the other hand, a light-fogging method is practically convenient because such a strict condition as abovementioned is not required, however, there remains some technical problem to be solved in order to apply this method to the color photographic fields to satisfy a variety of the objects. To be more concrete, in a light-fogging method, the fundamental factor for inducing a development action is the formation of a silver nuclei, i.e.,; a fogging nuclei, produced by the photodecomposition of a silver halide, therefore, an exposure illuminance, an exposure quantity or the like is varied according to the characteristics of an exposure light source and to the kinds of a silver halide to be used.

For example, in Japanese Patent Examined Publication No. 12709/1970, there described that a fogging exposure are applied by a low illuminance, and as the result that the inventors of the invention have studied, it was found the facts that it was required to apply a fogging exposure of a certain limited range of relatively lower illuminance in order to obtain a relatively better positive image, and that in the case of a further lower illuminance than those within the abovementioned range the satisfactory maximum image density cannot be obtained even if a sufficient quantity of exposure is applied, while in the case of higher illuminance than those within the range the maximum density is lowered in proportion to the illuminance and the minimum density is also increased further, and it was also clarified that there is the phenomenon of the so-called "Intensity reciprocity law failure" in a light-fog. And, in producing a positive color image in the manner that a light-fogging method is applied to a multi-layered color photosensitive material comprising a blue-sensitive, a green-sensitive and a red-sensitive silver halide emulsion layers and the development is processed, it is desired to select the most suitable conditions for a fogging exposure, taking into consideration of the sensitivity balance between the photosensitive emulsion layers with each other (hereinafter referred to as "color-balance").

With reference to the fogging-exposure conditions to satisfy the requirements as described above, there are the technical descriptions in Japanese Patent Application Nos. 39849/1980 and 15002/1981 disclosing that a highly color-rendering light-source is used as a fogging-exposure light-source and, in addition, the exposure is made through an ultra-violet absorbing filter.

However, it was found out that there are some instances where an excellent positive color image cannot be obtained to be fully satisfied by only the selection of a light source and the combination of an ultra-violet absorbing filter as mentioned above. That is to say, in the high density areas (i.e. the shadow areas), the sensitometric characteristics of every layer become ill-balanced with each other, and in particular, the maximum density of the upper layers become lower as compared with the lower layers (i.e.; the photosensitive layers adjacent to the support), so that the color-balance will deteriorate. And, in the low density areas (i.e.; the high-light areas), the sensitometric characteristics of every layer become also ill-balanced, and in particular, the minimum density of the upper layers become relatively higher than those of the lower layers, so that the sensitivity is relatively lowered and the color-balance is deteriorated. These facts will spell the defects in the color reproducibility and the contrast of an over-all positive color image.

The inventors of the invention devoted themselves to study to solve the abovementioned difficult points and have thus accomplish the present invention.

It is therefore an object of the invention to provide a method to form an excellently well-balanced positive-color image and a highly contrasty positive color image of which the upper-most layer is most contrasty in particular, by making use of an internal latent image type direct positive silver halide color photosensitive material.

The inventors have discovered the fact that the above-mentioned object of the invention can be accomplished through a method for forming a direct positive color image by applying a fogging exposure under a wet condition with a solution containing a fluorescent whitening agent, in an image forming method in which, a direct positive silver halide color photosensitive material, having a support and at least one light-sensitive silver halide emulsion layer each of blue-, green- and red-sensitive silver halide emulsion layers every of which contains internal latent image type silver halide grains whose surfaces are not fogged, is exposed imagewise to light and is then applied by a fogging-exposure, and further a color development is made to obtain a direct positive color image.

The invention will be understood more detailedly in reference to the following descriptions.

In the direct positive color image forming methods of the invention, there are characterized in that a direct positive silver halide color photosensitive material is exposed imagewise, and thereafter, in applying a fogging-exposure thereto, an over-all exposure is applied in the presence of a solution containing a fluorescent whitening agent, namely, the over-all exposure is applied after the abovementioned color photosensitive material is wetted with the aforesaid solution.

As for the fluorescent whitening agents to be used in the invention, the following examples are given:

A. Stilbene compounds

The compounds given in the following General Formula [I] are included therein.

Formula [I]

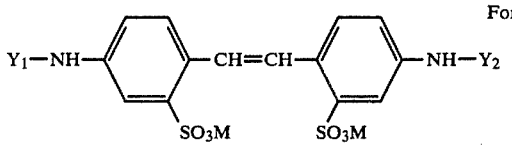

wherein, $Y_1$ and $Y_2$ represent respectively

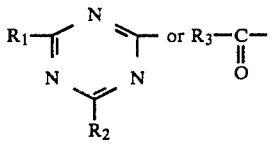

group in which $R_1$, $R_2$ and $R_3$ represent respectively a hydroxyl group, a halogen atom such as chlorine atom and bromine atom, a morpholino group, a substituted or unsubstituted alkoxy group such as methoxy, ethoxy and methoxyethoxy group, a substituted or unsubstituted aryloxy group such as phenoxy and p-sulfophenoxy group, a substituted or unsubstituted alkyl group such as methyl and ethyl groups, a substituted or unsubstituted aryl group such as phenyl and methoxyphenyl groups, an amino group, a substituted or unsubstituted alkylamino group such as methylamino, ethylamino, propylamino, dimethylamino, cyclophexylamino, β-hydroxyethylamino, di(β-hydroxyethyl-)amino, β-sulfoethylamino, N-(β-sulfoethyl)-N'-methylamino, N-(β-hydroxyethyl)-N'-methylamino groups, a substituted or unsubstituted arylamino group such as anilino, o-, m-, p-sulfanilino, o-, m-, p-chloranilino, o-, m-, p-toluidino, o-, m-, p-carboxyanilino, o-, m-, p-hydroxyanilino, sulfonaphthylamino, o-, m-, p-aminoanilino, and o-, m-, p-anisidino groups.

To be more concrete, as for the compounds to be included in those formulated in the abovegiven Formula, the following compounds are given;

A-1

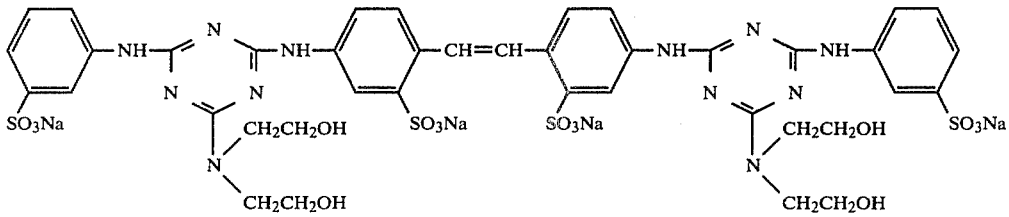

-continued
A-2
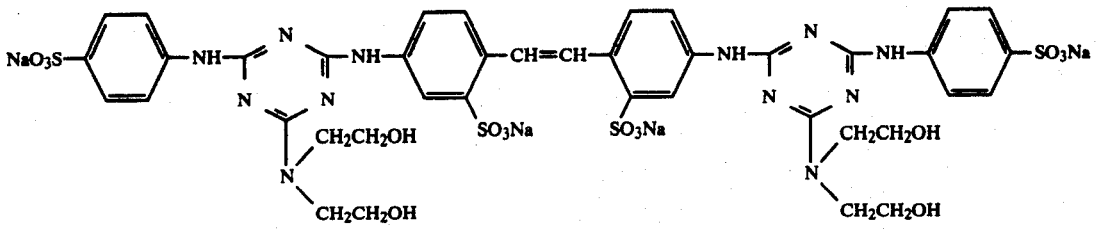
A-3
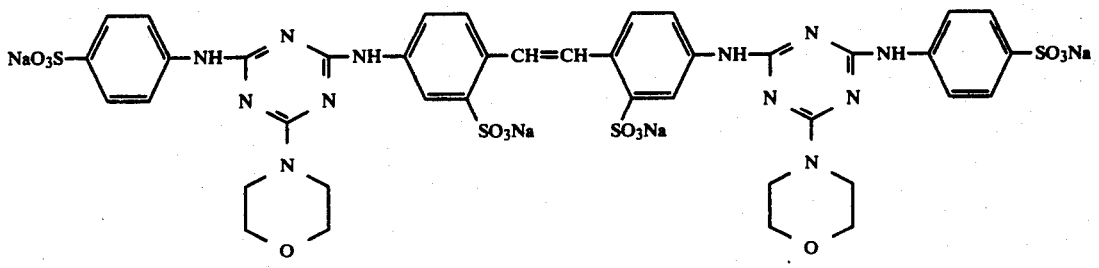
A-4
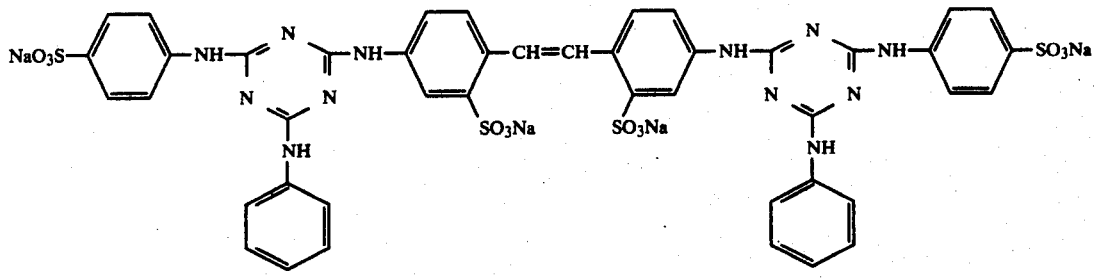
A-5
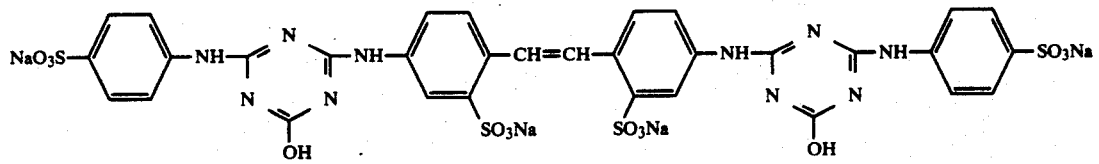
A-6
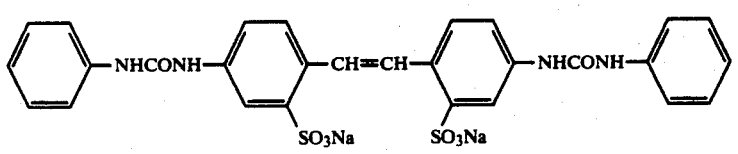
A-7
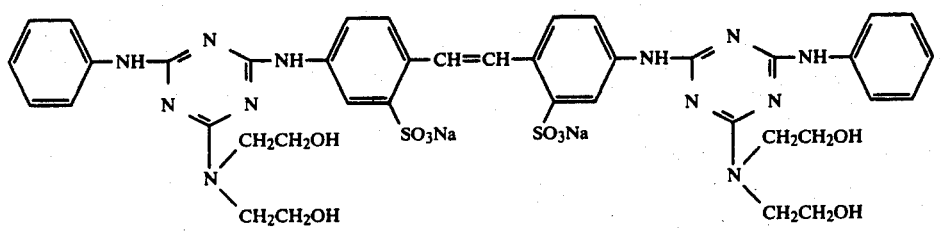
A-8
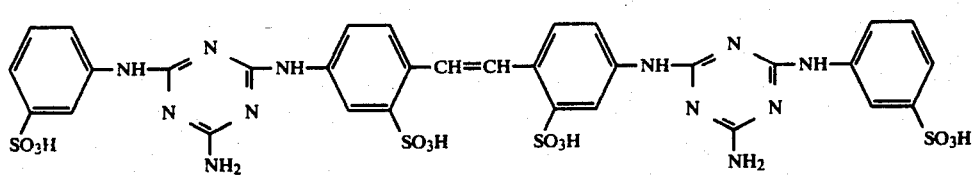

-continued
A-9
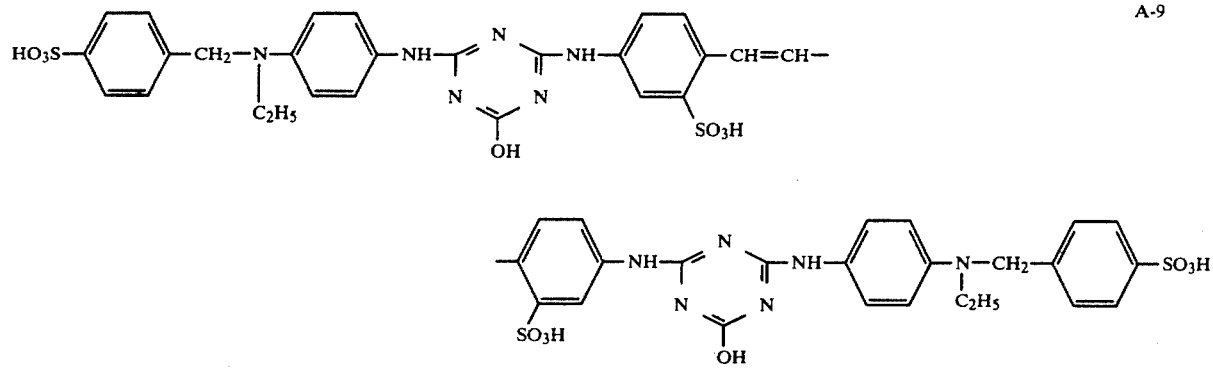
A-10
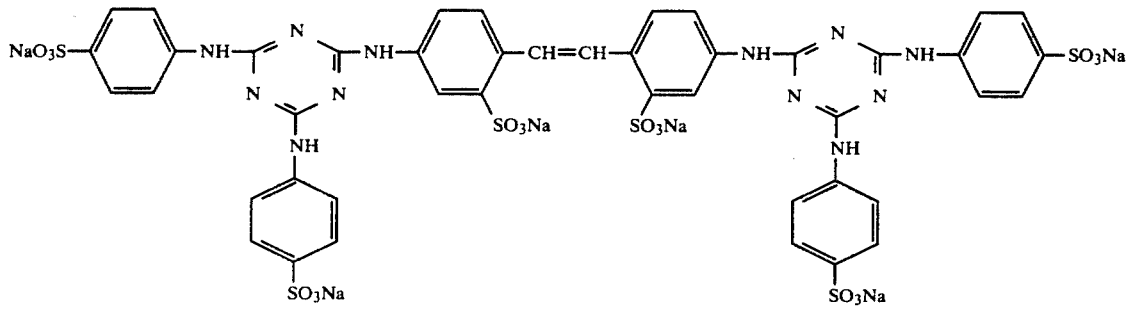
A-11
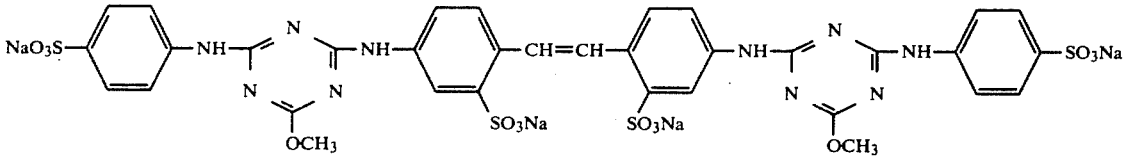
A-12
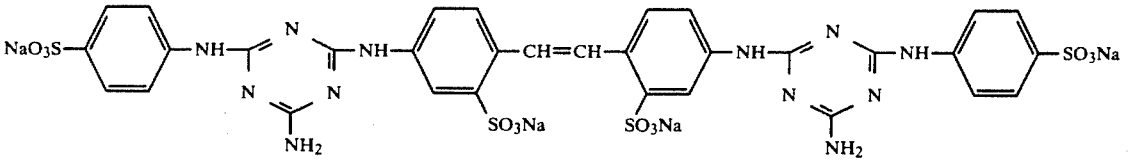
A-13
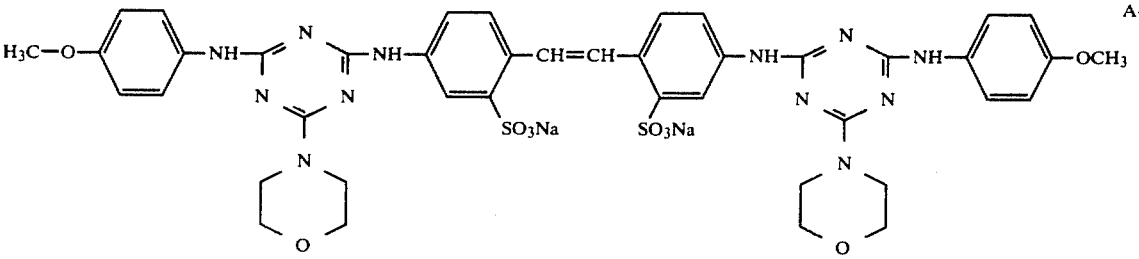
A-14
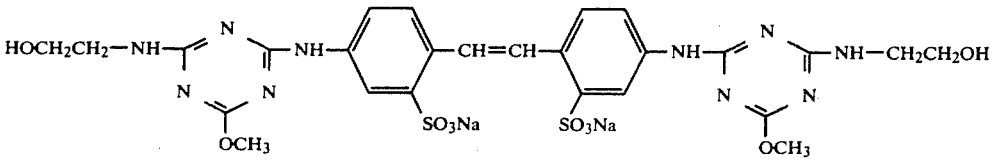

-continued
A-15
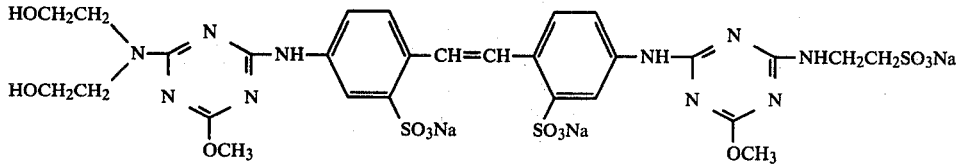
A-16
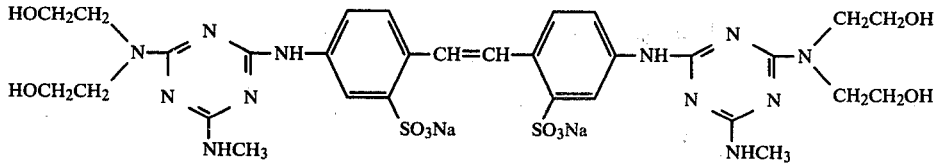
A-17
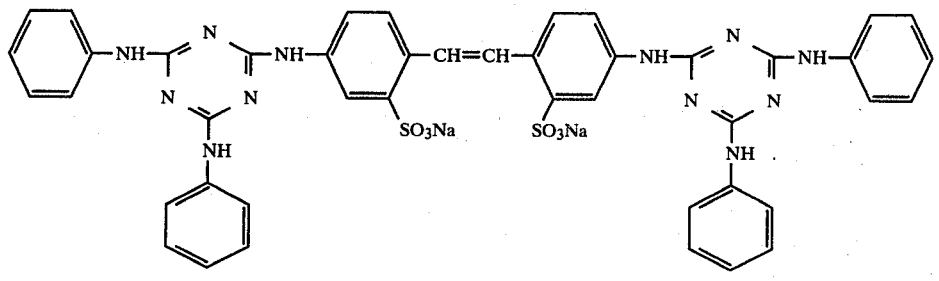
A-18
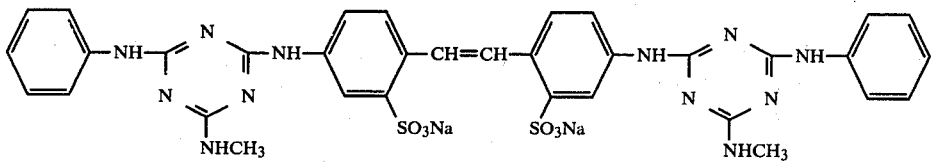
A-19
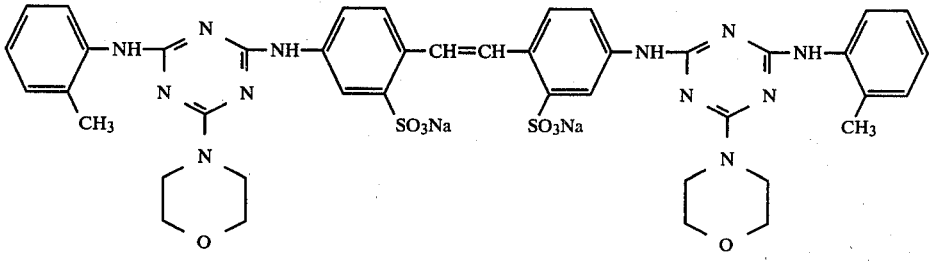
A-20
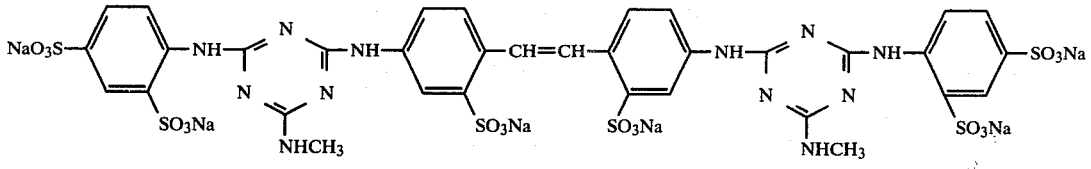
(A-21)
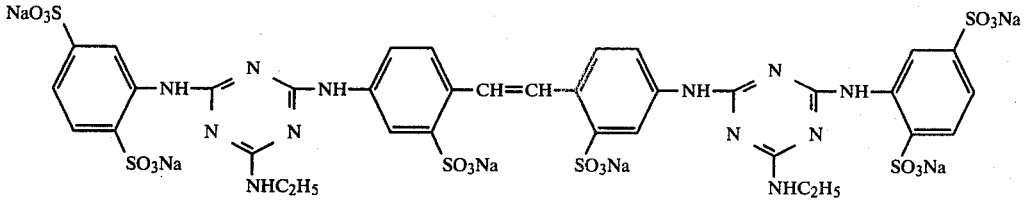
B. Coumalin Compounds
To be concrete, the following compounds are given:

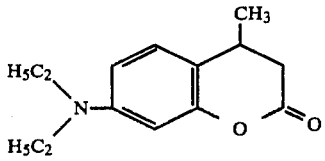

C. Biphenyl Compounds

To be concrete, the following compounds are given:

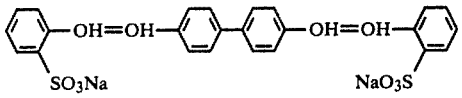

D. Azole Compounds

To be concrete, the following compounds are given:

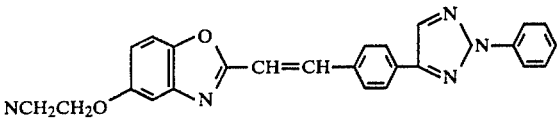

E. Naphthalimide Compounds

To be concrete, the following compounds are given:

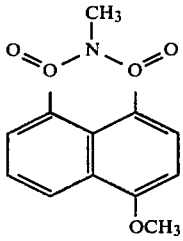

F. Pyrazoline Compounds

To be concrete, the following compounds are given:

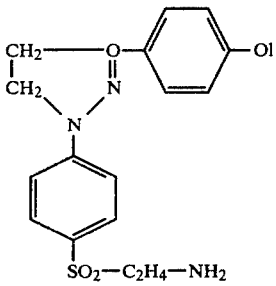

It is preferable to contain a fluorescent whitening agent to be used in the invention at the ratio of 0.1–30 g thereof to one liter of the solution, and more preferably at the ratio within 0.1–10 g thereof. It may also be allowed to use only one kind of the abovementioned fluorescent whitening agents or may be allowed to use two or more kinds of them jointly.

As for the solutions for dissolving the aforesaid fluorescent whitening agents, not only pure water but also a color developing liquid or a pretreatment liquid that is to be used in a process before the color development process are included, and inter alia, a color developing liquid is preferably used.

Accordingly, a fogging-exposure for embodying the invention can be performed in such a way that a color photosensitive material having already been exposed imagewise is over-all exposed to light under such a condition that the above mentioned photosensitive material is dipped into an aqueous solution containing a single substance of the abovementioned fluorescent whitening agent or into a pretreatment liquid containing a fluorescent whitening agent, that is to be used before the color development process, or in such a way that a color photosensitive material having already been exposed imagewise is over-all exposed to light by dipping the photosensitive material into a solution which was prepared by dissolving and containing a fluorescent whitening agent to a color developing liquid and then by keeping on color-developing.

In either way to be taken, it is desired to apply a uniform exposure onto the over-all surface of a color photosensitive material under the condition that the solution containing the abovementioned fluorescent whitening agent is sufficiently permeated into the color photosensitive material, or under the condition that the abovementioned solution forms a thin coated layer by itself over the photosensitive material.

As for the light sources for fogging-exposure to be used in the invention, any light source may be used if the wavelength thereof is within the photosensitive wavelength range of a color photosensitive material, and it is possible to illuminate a high intensity light such as a flash-light in a short space of time, or it is also allowed to illuminate a dim light for a long time. Such light-fog illuminance may be adjusted by changing the intensity of a light source or by utilizing the light attenuation by means of a filter or the like selected out from various kinds thereof or by allowing for the distance and angle between the photosensitive material and the light source. And, with the purpose of shortening a light-fogging exposure time, it is possible to take a method in that a photosensitive material is fogged with a low intensity light at the initial stage of a light-fogging exposure and the photosensitive material is then fogged with a higher intensity light. A fogging-exposure time may be adjusted widely by suitably selecting a photosensitive material, a development condition and a light source, so as to ultimately obtain a best positive image.

The color developing liquids to be used in the invention mean those not substantially containing any silver halide solvent, and as for the developers capable of being used in the color developing liquid, the ordinary color developers are given. As for the preferable color developing agents, an aromatic primary amino compound is given, and inter alia, the typical ones are given a p-phenylene diamine and a p-aminophenol. The examples thereof include aminophenol, N-methylaminophenol, N,N-diethyl-p-phenylenediamine, 4-amino-3-methyl-N-ethyl-N-(β-methane sulfonamidoethyl)aniline, 4-amino-3-methyl-N-ethyl-N-(β-hydroxy ethyl-)aniline, 4-amino-3-methyl-N,N-diethyl-p-phenylenediamine, 4-amino-3-methyl-N-ethyl-N-β-methoxyethyl-p-phenylenediamine, and the like. It is also possible that the abovementioned developer is soaked in an emulsion in advance and is made to act on silver halide while they are being soaked in a high pH aqueous solution and the method of the invention is then applied.

The amount used of the aromatic primary amino compound is varied in accordance with the kinds of photosensitive material to be used. It is easy to determine the amount thereof experimentally, and it is allowable to use the compound at the rate of 0.0002–0.7 mol thereof to one liter of developing liquid, in general.

It is also possible that the abovementioned color developing liquid may contain, in addition to the aromatic primary amino compounds, an ordinary black-and-white developer, for example, a polyhydroxybenzene such as hydroquinone, a 3-pyrazolidone, ascorbic acid and the derivatives thereof, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, and the like.

It is further possible that the color developing liquid contains a specific antifoggant and development inhibitor, or that the additives for a developing liquid is added in option to the constitutional layers of a photosensitive material. Usually, the useful antifoggants include a benzotriazole, a benzimidazole, a benzothiazole, a benzoxyazole, a heterocyclic thion such as 1-phenyl-5-mercaptotetrazole, an aromatic or an aliphatic mercapto compound and the like.

It is further allowed to add anyone of a variety of usual types of components into the color developing liquid. For example, an alkaline substance such as sodium hydroxide, sodium carbonate and potassium carbonate; an alkali metal sulfite; an alkali metal bisulfite; an alkali metal halogenide; benzyl alcohol; a water softener; a thickener; a development accelerator; and the like. The pH values of the color developing liquids are usually at pH 7 or higher, and, to be most usual, they are about 9–14.5, and further preferably, they are 10–14.

Here enters into details of a variety of additives which are to be added on demand into the abovementioned color developing liquids. They are, for example, the additives for keeping a pH value constant such as a hydroxide of an alkali metal or ammonium, a carbonate, a phosphate, a pH adjuster or buffer such as a weak acid or a weak acid base, e.g., acetic acid and boric acid and the salts thereof; and a development accelerator such as a pyridium compound, a cationic compound, potassium nitrate and sodium nitrate, a polyethylene glycol condensate, phenyl cellosolve, phenylcarbitol, alkylcellosolve, dialkyl formaldehyde, alkylphosphate, and the derivatives thereof, a nonionic compound such as a polythioether, a polymeric compound having a sulfite ester, and in addition, an organic amine such as pyridine and ethanol amine, and benzyl alcohol.

The processing temperature of the color developing liquid is normally at 20° C.–70° C., and more preferably, at 30° C.–45° C.

As for the additives, besides the above, for the color developing liquid to be used in the invention, there are given a stain preventive, a sludge preventive, an interimage effect accelerator, a preservative such as a sulfite, a hydroxylamine hydrochloride, formsulfite, an alkanolamine sulfite adduct. As for the chelating agents, there can be used a phosphate such as a polyphosphate; an aminopolycarbonate such as nitrilo triacetate, and 1-3-diamino-2-propanoltetracetate; an oxycarbonic acid such as citric acid and gluconic acid; 1-hydroxy ethylidene; 1,1-diphosphonic acid; hydroxyimino diacetic acid; lower aliphatic carbonic acid; and the like including a water-soluble inorganic metal salt of magnesium, aluminium, zinc, barium or zirconium; lithium chloride; and lithium sulfate. The chelating agents may be allowed to use independently or jointly with two or more kinds thereof.

A silver halide emulsion to be used in the photosensitive materials of the invention is an emulsion, wherein a latent image is formed mainly inside the silver halide grains whose surfaces are not fogged in advance and the greater part of the sensitivity specks are inside the grains, and the emulsions include an arbitrary silver halide emulsion such as that of silver bromide, silver chloride, silver chlorobromide, silver iodobromide, or silver chloriodobromide.

As for an internal latent image type silver halide grain to be used in the invention, it is preferable that the surface of the grain is not chemically sensitized or is sensitized slightly even if that is the case.

The meaning of the expression, the surface of a grain is not fogged in advance, is that a test piece is prepared by coating on the support made of a sheet of transparent film with an emulsion used in the invention so that the ratio of the amount coated can be at 35 mg Ag/dm$^2$, and that the test piece thus prepared is developed, without any exposure to light, with the surface developing liquid A mentioned below at 20° C. for ten minutes to give the density of 0.6, and more preferably, not exceeding 0.4.

| [Surface Developing Liquid A] | |
|---|---|
| Metol (p-methylaminophenol sulfate) | 2.5 g |
| l-ascorbic acid | 10.0 g |
| $NaBO_2.4H_2O$ | 35.0 g |
| Add water to make | 1 ltr. |

With the silver halide emulsions of the invention, a satisfactory density is produced in the case that a test piece thus prepared as mentioned before is exposed to light and is then developed with the internal developing liquid B having the undermentioned formula.

| [Internal Developing Liquid B] | |
|---|---|
| Metol | 2 g |
| Sodium sulfite, anhydrous | 90 g |
| Hydroquinone | 8 g |
| Sodium carbonate, monohydrate | 52.5 g |
| KBr | 5 g |
| KI | 0.5 g |
| Add water to make | 1 ltr. |

To be more concrete, in the case that a portion of the abovementioned test piece is exposed to light through a light intensity scale extending for a prescribed period of time not longer than about one second and is then developed with the aforementioned internal developing liquid B at 20° C. for 4 minutes, the maximum density thereof shows at least five times and more preferably at least ten times as dense as that obtained in the case that the other portion of the test piece is exposed to light under the same conditions and is then developed with the aforementioned surface developing liquid A at 20° C. for 4 minutes.

To be further more concrete to give the examples thereof, there can be given a conversion type silver halide emulsion as described in U.S. Pat. No. 2,592,250, a core/shell type silver halide emulsion that is doped with an internal chemical sensitization speck or a polyvalent metal ion as described in U.S. Pat. Nos. 3,761,266 and 3,761,276, a lamination layer type silver halide emulsion as described in Japanese Patent Publication Open to Public Inspection Nos. 8524/1975, 38525/1975 and 2408/1978, and besides, the emulsions as described in Japanese Patent Publication Open to Public Inspection Nos. 156614/1977 and 127549/1981, and the like.

The silver halide emulsions of the invention may be optically sensitized with a sensitizing dye that is popularly used, and the combinations of the sensitizing dyes which are used for super-sensitizing an internal latent image type silver halide emulsion, a negative type silver halide emulsion and the like, the combination thereof is useful to the silver halide emulsions of the invention. Such sensitizing dyes may be referred to "Research Disclosure", No. 15162.

The silver halide emulsions may also contain a stabilizer being popularly used such as a compound having an azaindene ring and a heterocyclic compound having mercapto, and inter alia, 4-hydroxy-6-methyl-1,3,3a,7-tetrazaindene and 1-phenyl-5-mercaptotetrazole and the like can be given respectively as the typical examples thereof.

In addition thereto, a mercury compound, a triazole compound, an azaindene compound, a benzothiazolium compound, a zinc compound and the like, for example, can be used with the silver halide emulsions of the invention to serve as an antifoggant or a stabilizer.

Further into the silver halide emulsions, a variety of the additives for photographic use may arbitrarily be added. In the invention, besides the above and among the other additives usable according to the purposes, for example, hydroxyalkane and the like are given as a wetting agent; and as a physical property modifier for emulsions, there are suitably given a water-dispersible fine-grain macromolecular substance obtained through an emulsion polymerization of a copolymer of alkylacrylate or alkylmethacrylate and acrylic acid or methacrylic acid, a styrene-maleic acid copolymer, a styrene maleic acid anhydrous-half alkylester copolymer, and the like; and as a coating assistant, saponin, polyethylene glycol lauryl ether and the like are included. As the other additives for photographic use, it is arbitrary to use a gelatin plasticizer, a surface active agent, an ultra violet ray absorbent, a pH adjuster, an oxidation inhibitor, an antistatic agent, a thickener, a graininess improving agent, a dye, a mordant, a whitening agent, a development speed adjuster, a matting agent, and the like.

The silver halide emulsion having been prepared as described above is coated over to a support, through a sub-layer, an antihalation layer, a filter layer, and the like as occasion demands, and thus, an internal latent image type silver halide photosensitive material is obtained.

A photosensitive material relating to the invention has at least one layer each of a blue-sensitive, a green-sensitive, and a red-sensitive emulsion layer respectively to form each of the yellow, magenta and cyan dye images. Among the color forming agents, i.e., the couplers, as for the yellow couplers, there can be used an open-chained ketomethylene compound, and besides there can also be effectively used a benzoyl acetanilide yellow coupler, a pivaloylacetanilide yellow coupler or also a two-equivalent type yellow coupler of which a carbon atom at the coupling position has a substituent capable of being split-off at the time of the coupling. And, as for the magenta couplers, the compound of a pyrazolone, a pyrazolitriazole, a pyrazolinobenzimidazole, or an indazolone, the compound can be used for. Further, as for the cyan couplers, the derivatives of a phenol compound or of a naphthol compound can be used for.

It is also effective to use an ultra-violet ray absorbent such as a compound of thiazolidone, benzotriazole, acrylonitrile, or benzophenone, in order to prevent a photosensitive material from being brownish by a short wavelength active ray of light from a dye image, and it is especially advantageous to use independently or jointly Jinuvin PS, the same 320, 326, 327 and 328, those are mfd, by Ciba-Geigy.

As for the supports for the photosensitive material, any arbitrary ones may be used, and inter alia, a polyethyleneterephthalate film, a polycarbonate film, a polystyrene film, a cellulose acetate film, a baryta paper, a polyethylene laminated paper, or the like which is sublayered as occasion demands; those are included in the supports as the typical examples.

Into the silver halide emulsions of the invention, a suitable gelatin derivatives besides gelatin can be used to serve as a protection colloid or a binder, as occasion demands. As for the gelatin derivatives, acylated gelatin, guanidylated gelatin, carbamylated gelatin, cyanoethnolated gelatin, esterified gelatin and the like may be given as the examples.

A hydrophilic binder may also be contained as to fit the purposes, and as for the suitable binders besides gelatin, there include colloidal albumin, agar, gum arabic, dextran, alginic acid, a cellulose derivative such as cellulose acetate hydrolyzed so that the acetyl contents can be upt to 19–20%, polyacrylamide, imidified polyacrylamide, casein, a vinylalcohol polymer containing an urethane carbonic acid group or a cyanacetyl group, such as vinylalcohol-vinylaminoacetate copolymer, polyvinyl alcohol, polyvinyl pyrolidone, hydrolyzed polyvinyl acetate, a polymer prepared by polymerization of a protein or a saturatedly acylated protein and a monomer having a vinyl group, polyvinyl pyridine, polyvinylamine, polyaminoethylmethacrylate, polyethyleneamine, and the like; and such binders may be added, according to the purposes, into the constitutional layers of a photosensitive material, such as emulsion layers or interlayers, a protective layer, a filter layer, a backing layer and the like, and a suitable plasticizer, a lubricant and the like may further be held in the abovementioned hydrophilic binders so as to answer the purposes.

The constitutional layers of a photosensitive material relating to the invention may also be hardened with a suitable emulsion hardener at will. As for the hardeners, there may be given, for example, a chromium salt; a zirconium salt; an aldehyde, halotriazine, or polyepoxy compound such as formaldehyde or mucohalogenoacid; an ethylenimine, vinylsulfonic or acryloyl hardener; and the like.

Further, the photosensitive material is allowed to be coated over the support thereof with many of various photographic constitutional layers such as an emulsion layer, a filter layer, an interlayer, a protective layer, a sublayer, a backing layer, an antihalation layer, and the like.

The photosensitive materials to be used in the invention are the ordinary type of multilayered direct positive color photosensitive materials which will basically form the dye images in three colors as described above, i.e., yellow, magenta and cyan, and besides the above, the invention may effectively be applied also to a false-colored direct positive color photosensitive material and to a color photosensitive material containing a compound capable of forming a black image at the time of a color development.

It is also possible to apply the fogging exposure method of the invention to such a direct positive color photosensitive material in which both of couplers and color developing agent or the precursors thereof are held in one and the same layer so as to prevent both of them from coming into contact with each other while the photosensitive material is not yet exposed to light, and to such a direct positive color photosensitive material in which a color developing agent or the precursors thereof are held in a layer not containing any coupler and the alkaline hydrolyzed products of the color developing agent or the precursors thereof are transferred at the time when an alkali processing liquid is permeated therein so as to bring the agents or the precursors thereof into contact with the couplers.

In processing the photosensitive material relating to the invention in the method as described above, a variety of processors may be used, for example, various types of transport systems such as a hanger type, a cine type, and a roller type ones, are usable to process the materials. In the case that a photosensitive material having been exposed to light is processed by an automatic processor, there has so far been used such a method in which the process is taken with replenishing the processor with processing liquid in accordance with the photosensitive materials to be processed, however, in the invention to be applied by making use of a replenisher kit that has been prepared in the liquefied units, it may be allowed to replenish by every unit of the kit. On the other hand, there have been developed the processes for recycling the used processing liquids as well as the processes to recover the chemicals such as a developing agent, a heavy metals and the like which are of essential for environmental pollutions or for natural resources, and there have been some apparatuses having been equipped with such a device as described above, which may be allowed to use suitably.

The following is the detailed descriptions of the invention with reference to the examples thereof, and it is to be understood that the invention and the embodiments thereof shall not be limited to the specific embodiments thereof.

EXAMPLE 1

The samples were prepared in such manner that each of the undermentioned layers was coated onto the resin-coated support of paper-made in the order from the support side.

Layer 1: A cyan forming red-sensitive silver halide emulsion layer

In conformity with the process described in Japanese Patent Publication Open to Public Inspection No. 127549/1980, the internal latent image type silver halide emulsion was prepared. To be concrete, 200 ml of the aqueous solution of one mol of silver nitrate were rapidly added into 220 ml of aqueous solution of one mol of potassium chloride containing 10 g of gelatin keeping the temperature at 60° C. After ten minutes of the physical ripening, there was added with the mixture solution of one mol of potassium bromide and 50 ml of aqueous solution of one mol of potassium iodide. Thus obtained conversion type silver chloroiodobromide grains were added with 150 ml of aqueous solution of one mol of silver nitrate by taking five minutes and were physically ripened for 20 minutes and were then washed, in order to cover the grains by silver chloride shells.

The cyan couplers were prepared through the process in which 70 g of 2,4-dichloro-3-methyl-6-[α-(2,4-di-tert-amylphenoxy)butylamide]phenol, 2 g of 2,5-di-tert-octyl hydroquinone, 50 g of dibutyl phthalate and 140 g of ethyl acetate were mixedly dissolved and thereto a gelatin solution containing sodium isopropyl naphthalene sulfonate was added and the emulsifiedly dispersion was made.

Next, the dispersion liquid was added to the above-mentioned emulsion that had been spectrally sensitized in advance with the following dyes,

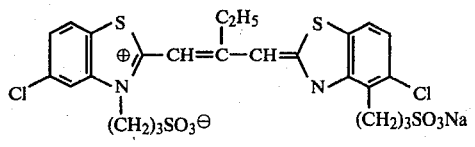

and

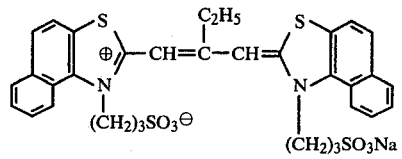

and, one gram of 4-hydroxy-6-methyl-1,3,3a,7-tetrazaindene and one gram of 2,5-dihydroxy-4-Sec-octadecyl-potassium benzenesulfonate were added thereto, and bis(vinyl sulfonyl methyl)ether was further added thereto to serve as an emulsion hardener, and thus the coating thereof was applied onto the support surface so that the amounts of silver and the couplers can be at 400 mg/m$^2$ and 460 mg/m$^2$, respectively.

Layer 2: Interlayer

The coating was applied onto Layer 1 with 100 ml of 2.5% gelatin solution containing 5 g of grey colloidal silver and 10 g of 2,5-di-tert-octyl hydroquinone which were dispersed in dibutyl phthalate, so that the amount of the colloidal silver can be at 400 mg/m$^2$.

Layer 3: A magenta forming green-sensitive silver halide emulsion layer

To serve as the magenta couplers, 40 g of 1-(2,4,6-trichlorophenyl)-3-(2-chloro-5-octadecyl succinimide anilino)-5-pyrazolone, 1 g of 2,5-di-tert-octylhydroquinone, 75 g of dioctylphthalate and 30 g of ethyl acetate were mixedly dissolved and the solution thus obtained was added into gelatin solution containing sodium isopropylnaphthalene sulfonate to emulsifiedly dispersed. Next, the dispersion liquid was added into the above-mentioned emulsion that had been spectrally sensitized in advance with the following dyes:

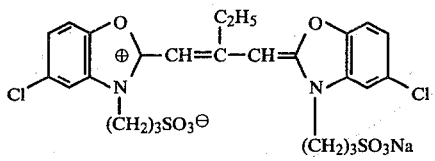

-continued and

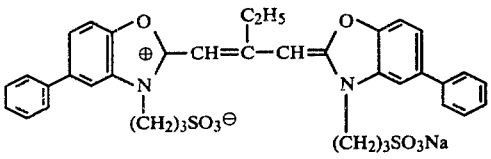

and again, one gram of 4-hydroxy-5-methyl-1,3,3a,7-tetrazaindene and one gram of 2,5-di-hydroxy-4-Sec-potassium octadecylbenzene sulfonate were added thereto, and further again bis(vinyl sulfonyl methyl)ether was added thereinto to serve as the hardener, and thus the solution prepared was coated onto Layer 2 so that the amounts of silver and the couplers could be at 400 mg/m$^2$, respectively.

Layer 4: Yellow filter layer

There coated Layer 3 with the 2.5% gelatin solution containing 5 g of yellow colloidal silver and 5 g of 2,5-di-tert-octylhydroquinone so that the coated amount of the colloidal silver could be at 200 mg/m$^2$.

Layer 5: A yellow color forming blue-sensitive silver halide emulsion layer

To serve as the yellow-couplers, 80 g of α-[4-(1-benzyl-2-phenyl-3,5-dioxo-1,2,4-triazolidinyl)]-α-pivalyl-2-chloro-5-[γ-(2,4-di-tert-amylphenoxy)-butylamide]acetanilide, 1 g of 2,5-di-tert-octylhydroquinone, 80 g of dibutyl phthalate and 200 g of ethyl acetate were mixedly dissolved, and gelatin solution containing sodium isopropylnaphthalene sulfonate was added into the solution prepared, and thus the emulsification dispersion was made. Next, the dispersion liquid was added into the aforementioned emulsion and then 1 g of 4-hydroxy-6-methyl-1,3,3a,7-tetrazaindene and 1 g of 2,5-dihydroxy-4-Sec-octadecyl-potassium benzene sulfonate were added, and bis(vinyl sulfonyl methyl)ether was further added thereinto to serve as the hardener. Thus the coating was made onto Layer 4 so that the coated amounts of silver and the couplers could be at 400 mg/m$^2$ and 530 mg/m$^2$, respectively.

Layer 6: Protective layer

The coating of the layer was made so that the coated amount of gelatin could be at 200 mg/m$^2$.

By the way, Layer 1, 2, 3, 4, 5 and 6 were contained with saponin, respectively, that is to serve as the coating assistant.

Thus prepared samples were wedge-exposed to light respectively by means of a sensitometer, Model KS-7 (mfd. by Konishiroku Photo Ind. Co., Ltd.) and were then developed in the following process:

| Processing Step (at 38° C.) | Processing Time |
|---|---|
| Development | 2 min. 50 sec. |

Wherein, the light fogging exposure was applied for ten seconds in such a manner that the samples each was dipped in the developing liquid for ten seconds and then placed horizontally so that the samples could be at 1 cm's distance under the liquid surface.

-continued

| | |
|---|---|
| Bleach-Fix | 1 min. 30 sec. |
| Wash | 1 min. 30 sec. |

The conditions of the light-fogging exposure were so provided that a daylight type fluorescent lamp was used for the light source and the luminance was so set as to be at 1 lux on the photosensitive surface through a neutral-density filter.

The developing liquid used therein was as follows:

| Color developing liquid (1) | |
|---|---|
| Benzyl alcohol | 5 ml |
| Ethylene glycol | 10 ml |
| 3-methyl-4-amino-N—ethyl-N—(β-methane sulfonamide ethyl) aniline sulfonate | 5 g |
| Potassium sulfite | 2.3 g |
| Hydroxylamine sulfate | 3 g |
| Potassium bromide | 1.0 g |
| Potassium carbonate | 28 g |
| 1-hydroxyethylidene-1,1-diphosphonate | 0.5 g |
| Hydroxyethylimino diacetic acid | 4 g |
| Magnesium chloride, hexahydrate | 0.4 g |
| Add water to make | 1 ltr. |

Wherein, the pH value thereof was adjusted to pH 10.20 with potassium hydroxide.

Color developing liquid (2)

This was prepared by adding 2 g/l of Exemplified Compound A-1 to Color developing liquid (1).

Color developing liquid (3)

This was prepared by adding 2 g/l of Exemplified Compound A-5 to Color developing liquid (1).

Color developing liquid (4)

This was prepared by adding 2 g/l of Exemplified Compound A-15 to Color developing liquid (1).

Color developing liquid (5)

This was prepared by adding 2 g/l of Exemplified Compound A-20 to Color developing liquid (1).

Color developing liquid (6)

This was prepared by adding 2 g/l of Exemplified Compound B-1 to Color developing liquid (1).

Color developing liquid (7)

This was prepared by adding 2 g/l of Exemplified Compound C-1 to Color developing liquid (1).

In the case that the color developing liquid was changed in the pH value thereof by some additive, the pH value was adjusted to 10.20 with potassium hydroxide and 7 N sulfuric acid.

The bleach-fix bath used was as follows:

| Bleach-Fix bath | |
|---|---|
| Ammonium ethylenediamine tetraacetate | 50 g |
| Disodium ethylenediamine tetraacetate | 8 g |
| Ammonium thiosulfate | 100 g |
| Sodium sulfite | 10 g |

-continued

| Bleach-Fix bath | |
|---|---|
| Add water to make | 1 ltr. |

Wherein, the pH value thereof was adjusted to 7.0 with sodium hydroxide or glacial acetic acid.

Table-I shows the minimum density of yellow represented by (Y), magenta by (M) and cyan by (C) and the maximum density of gamma-1 and gamma-2, of the respective samples prepared through the abovementioned process.

Wherein, the value of the gamma-1 or of gamma-2 indicates the contrast of the sample, that is, the tangent of the angle made to the axis of the abscisas that is the starting point of the density from 0.15 to 0.5 on the characteristics curve of the former or 0.8 to 1.8 thereon of the latter.

TABLE I

| Color Developing Liquid | Minumum Density | | | Gamma-1 | | | Gamma-2 | | | Maximum Density | | |
|---|---|---|---|---|---|---|---|---|---|---|---|---|
| No. | Y | M | C | Y | M | C | Y | M | C | Y | M | C |
| 1 | 0.10 | 0.08 | 0.05 | 0.95 | 1.00 | 1.01 | 2.65 | 2.80 | 2.81 | 2.32 | 2.44 | 2.43 |
| 2 | 0.05 | 0.06 | 0.04 | 1.08 | 1.08 | 1.09 | 2.86 | 2.85 | 2.85 | 2.43 | 2.43 | 2.42 |
| 3 | 0.06 | 0.06 | 0.04 | 1.02 | 1.06 | 1.02 | 2.77 | 2.81 | 2.82 | 2.40 | 2.42 | 2.42 |
| 4 | 0.07 | 0.06 | 0.04 | 1.01 | 1.08 | 1.00 | 2.76 | 2.85 | 2.80 | 2.41 | 2.43 | 2.42 |
| 5 | 0.05 | 0.06 | 0.04 | 1.08 | 1.07 | 1.08 | 2.82 | 2.83 | 2.84 | 2.45 | 2.42 | 2.42 |
| 6 | 0.07 | 0.06 | 0.04 | 0.99 | 1.02 | 1.02 | 2.72 | 2.83 | 2.84 | 2.41 | 2.42 | 2.41 |
| 7 | 0.07 | 0.06 | 0.04 | 1.02 | 1.00 | 1.05 | 2.78 | 2.82 | 2.84 | 2.41 | 2.42 | 2.42 |

As is obvious from the results shown in Table-I, it can be found that Color Developing Liquid No. 2, 3, 4, 5, 6 and 7 each can develop the positive color images having the lower minimum density, the higher maximum density and the excellent color balance as compared with the developing liquid No. 1 of the control sample and that Color Developing Liquid No. 2 is, inter alia, more particularly excellent.

EXAMPLE 2

The wedge-exposures were applied to the same samples respectively as those prepared in Example 1, and the developments were made in the following process:

| Processing Step (at 38° C.) | Processing Time |
|---|---|
| Color developing | 2 min. 30 sec. |
| Bleach-Fix | 1 min. 30 sec. |
| Wash | 1 min. 30 sec. |

Wherein, the samples were dipped into the developing liquid for 10 seconds and taken out therefrom and placed horizontally, and thus the light-fogging exposures were applied for 10 seconds so that the light can be hit on the photosensitive surface of each sample vertically.

The conditions of the light-fogging exposure were so provided that a daylight type fluorescent lamp was used for the light source and the luminance was so set as to be at 1 lux on the photosensitive surface through a UV-filter No. L-39 (mfd. by Hoya Glass Works) and a neutral-density filter.

The color developing liquid used therein was that having the same composites as those in the developing liquid used in Example-1. The bleach-fix bath used therein was the same as that in Example-1.

In Table-II, there shows the minimum density of yellow represented by (Y), magenta by (M) and cyan by (C) and the maximum density of Gamma-1 and Gamma-2 of each of the samples prepared through the abovementioned process.

TABLE II

| Color Developing Liquid | Minimum Density | | | Gamma-1 | | | Gamma-2 | | | Maximum Density | | |
|---|---|---|---|---|---|---|---|---|---|---|---|---|
| No. | Y | M | C | Y | M | C | Y | M | C | Y | M | C |
| 1 | 0.11 | 0.08 | 0.06 | 0.93 | 1.00 | 1.00 | 2.64 | 2.81 | 2.82 | 2.25 | 2.42 | 2.41 |
| 2 | 0.05 | 0.05 | 0.04 | 1.08 | 1.08 | 1.08 | 2.85 | 2.85 | 2.84 | 2.41 | 2.42 | 2.42 |
| 3 | 0.06 | 0.06 | 0.04 | 1.03 | 1.07 | 1.05 | 2.80 | 2.83 | 2.83 | 2.37 | 2.40 | 2.40 |
| 4 | 0.07 | 0.05 | 0.05 | 1.02 | 1.06 | 1.06 | 2.78 | 2.82 | 2.80 | 2.38 | 2.42 | 2.41 |
| 5 | 0.05 | 0.04 | 0.04 | 1.09 | 1.06 | 1.08 | 2.88 | 2.84 | 2.82 | 2.42 | 2.40 | 2.42 |
| 6 | 0.07 | 0.06 | 0.04 | 1.01 | 1.04 | 1.06 | 2.75 | 2.80 | 2.81 | 2.36 | 2.40 | 2.39 |
| 7 | 0.07 | 0.05 | 0.04 | 1.02 | 1.06 | 1.05 | 2.77 | 2.81 | 2.82 | 2.36 | 2.38 | 2.40 |

As is obvious from the results shown in Table-II, it can be found that Color Developing Liquid No. 2, 3, 4, 5, 6 and 7 each relating to the invention can produce the positive color images having the lower minimum density, the higher maximum density and the excellent color balance as compared with the developing liquid No. 1 of the control sample, and that Color Developing Liquid No. 2 is, inter alia, more particularly excellent.

What is claimed is:

1. A method for forming a direct positive color image in which an imagewise exposure is applied to a direct positive silver halide color photosensitive material comprising a support and at least one light-sensitive silver halide emulsion layer selected from the group consisting of a blue-sensitive, a green-sensitive and a red-sensitive silver halide emulsion layers containing respectively internal latent image type silver halide grains whose surfaces are not fogged and a fogging exposure is then applied and further a color development is made, wherein said fogging exposure is applied in a wet condition with a solution containing a fluorescent whitening agent.

2. A method according to claim 1, wherein said fluorescent whitening agent is one selected from the group consisting of stilbene compounds, coumalin compounds, biphenyl-compounds, azole compounds, naphthalimide compounds and pyrazoline compounds.

3. A method according to claim 2, wherein said stilbene compounds are represented by the Formula:

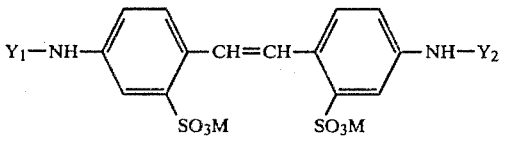

Wherein $Y_1$ and $Y_2$ represent respectively

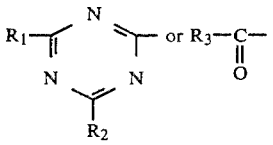

group in which $R_1$, $R_2$ and $R_3$ represent respectively a hydroxyl group, a halogen atom, a morpholino group, an alkoxy group, an aryloxy group, an alkyl group, an aryl group, an amino group, an alkylamino group, an arylamino group.

4. A method according to claim 1, wherein said fogging exposure is applied by exposing the entire surface of said photosensitive material.

5. A method according to claim 1, wherein said light-sensitive silver halide emulsion layer would give the density of 0.6 when the density of silver of said emulsion layer is 35 mg $Ag/dm^2$ and said emulsion layer provided on said support is developed without any exposure to light, with the surface developing liquid A mentioned below at 20° C. for ten minutes:

| Surface Developing Liquid A: | |
|---|---|
| Metol (p-methylamino-phenol sulfate) | 2.5 g |
| l-ascorbic acid | 10 g |
| $NaBO_2.4H_2O$ | 35 g |
| KBr | 1 g |
| Add water to make | 1 ltr. |

6. A method according to claim 1, wherein said light-sensitive silver halide emulsion layer would give a maximum density which is at least 5 times, when exposed for a given time up to 1 second and then developed at 20° C. for 4 minutes with an internal developing liquid B mentioned below, as dense as that obtained when exposed to light under the same condition and is then developed with a surface developing liquid A:

| Surface Developing Liquid A: | |
|---|---|
| Metol (p-methylamino-phenol sulfate) | 2.5 g |
| l-ascorbic acid | 10 g |
| $NaBO_2.4H_2O$ | 35 g |
| KBr | 1 g |
| Add water to make | 1 ltr. |
| Internal Developing Liquid B: | |
| Metol | 2 g |
| Sodium sulfite, anhydrous | 90 g |
| Hydroquinone | 8 g |
| Sodium carbonate, monohydrate | 52.5 g |
| KBr | 5 g |
| KI | 0.5 g |
| Add water to make | 1 ltr. |

* * * * *